US006817955B2

(12) United States Patent
O'Donnell et al.

(10) Patent No.: US 6,817,955 B2
(45) Date of Patent: Nov. 16, 2004

(54) GOLFING ACCESSORY TO REDUCE BENDING AND STOOPING BY GOLFER

(76) Inventors: Jerry L. O'Donnell, 3906 Onawa Dr., Waterloo, IA (US) 50701; James A. Egli, 709 Iowa St., Cedar Falls, IA (US) 50613

( * ) Notice: Subject to any disclaimer, the term of this patent is extended or adjusted under 35 U.S.C. 154(b) by 0 days.

(21) Appl. No.: 10/266,424

(22) Filed: Oct. 8, 2002

(65) Prior Publication Data

US 2004/0067798 A1 Apr. 8, 2004

(51) Int. Cl.[7] ..... A63B 47/02

(52) U.S. Cl. ..... 473/284; 473/286; 473/386; 294/19.2

(58) Field of Search ..... 473/282, 284, 473/286, 132, 133, 386; 294/19.2

(56) References Cited

U.S. PATENT DOCUMENTS 3,239,264 A * 3/1966 Dupont ..... 294/19.2
4,163,554 A * 8/1979 Bernhardt ..... 473/255
4,313,604 A * 2/1982 Baxter ..... 473/132
5,437,449 A * 8/1995 Zink ..... 473/286
5,460,366 A * 10/1995 Pugh ..... 473/286
5,839,972 A * 11/1998 Swanson ..... 473/286
5,857,927 A * 1/1999 Driscoll et al. ..... 473/386
5,899,511 A * 5/1999 Dinatale ..... 294/19.2
2003/0013540 A1 1/2003 Penrose

* cited by examiner

*Primary Examiner*—Stephen Blau

(57) ABSTRACT

A golfing tool or accessory to reduce or eliminate substantial stooping and bending of a golfer includes a mounting member for snap-fitting the tool or accessory to a golf club shaft or grip and first member for cradling a golf ball. Another aspect of the invention includes a tee holder for holding the tee to allow it to be inserted into the ground by manipulating the golf club shaft without stooping or bending. Further aspects of the invention can include structure for picking up a tee lying horizontally on the ground and a scissors-action of jaws of the tool for popping a golf ball into position on the tool.

32 Claims, 9 Drawing Sheets

GOLFING ACCESSORY TO REDUCE BENDING AND STOOPING BY GOLFER

BACKGROUND OF THE INVENTION

A. Field of the Invention

The present invention relates to golfing accessories, and in particular, to an accessory that assists a golfer by reducing the amount of bending or stooping of the golfer during play or practice.

B. Problems in the Art

The game of golf has relatively recently seen substantial resurgence in popularity, not only for spectators, but also participants. Additionally, at least in the United States, there has recently been an expansion in the percentage in the population of middle and older ages, and thus more persons of advanced age play golf.

Although golfing may not be considered a strenuous exercise, it is still athletic and requires a considerable amount of bending and stooping, particularly when teeing a ball up or picking a ball or tee up from the ground.

Many people who otherwise desire to play the game of golf, either limit their amount of play or resist playing because of such stooping and bending. This can be especially true for aging persons who have difficulty bending or stooping. This also includes persons of any age who have medical conditions that make it difficult to bend or stoop. One example is hip or knee replacements.

Therefore, there is a real need to address and solve this problem for the golfing enjoyment of a substantial number of persons.

SUMMARY OF THE INVENTION

It is therefore principal object, feature, and/or advantage of the present invention to present a golfing tool or accessory and method of using the same, which solves the problems and deficiencies in the art.

Other objects, features, and/or advantages of the present invention include a golfing accessory or tool and method of using the same which:

a. is easy and efficient to use;

b. is economical to make and to purchase;

c. is useable with most golf clubs;

d. is non-bulky and portable;

e. is flexible and useful for alleviating the necessity for stooping and bending for several stooping and bending tasks in golf;

f. is durable.

These and other objects, features, and/or advantages of the present invention will become more apparent with reference to the accompanying specification and claims.

According to one aspect of the invention, a golf tool according to the invention includes a body. A receiver is connected to the body and includes structure to clip on, snap onto, or otherwise removeably attach to a golf club. A ball holder is connected to the body and is adapted to cradle or grip a golf ball to move it from location to location.

According to another aspect of the invention, the tool includes a member to releasably hold a golf tee, and allow the tee to be inserted into the ground and the tool removed from the tee, leaving the tee in the ground.

According to a still further aspect of the invention, the ball holder is adapted to allow movement of the ball by manipulation of the golf club to a tee in the ground and removal of the tool leaving the ball on the tee.

According to a still further aspect of the invention, the tool includes a tee pick, comprising one or more fingers that can be forced around the shaft of the tee to pick a tee up from a generally horizontal position, for example, off the ground.

DETAILED DESCRIPTION OF EXEMPLARY EMBODIMENT

A. Overview

Figure 1:
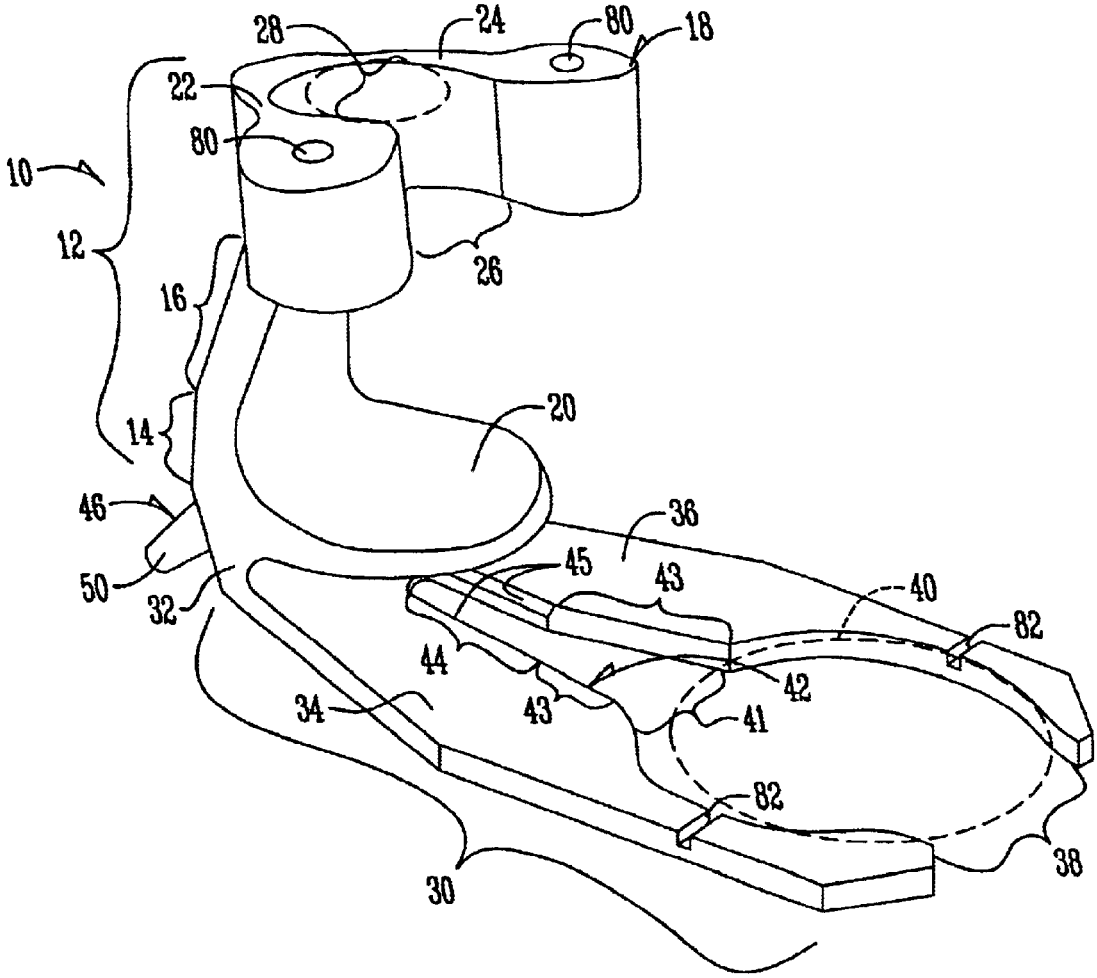
FIG. 1 is an enlarged perspective view of an exemplary embodiment of the present invention.
Figure 2:
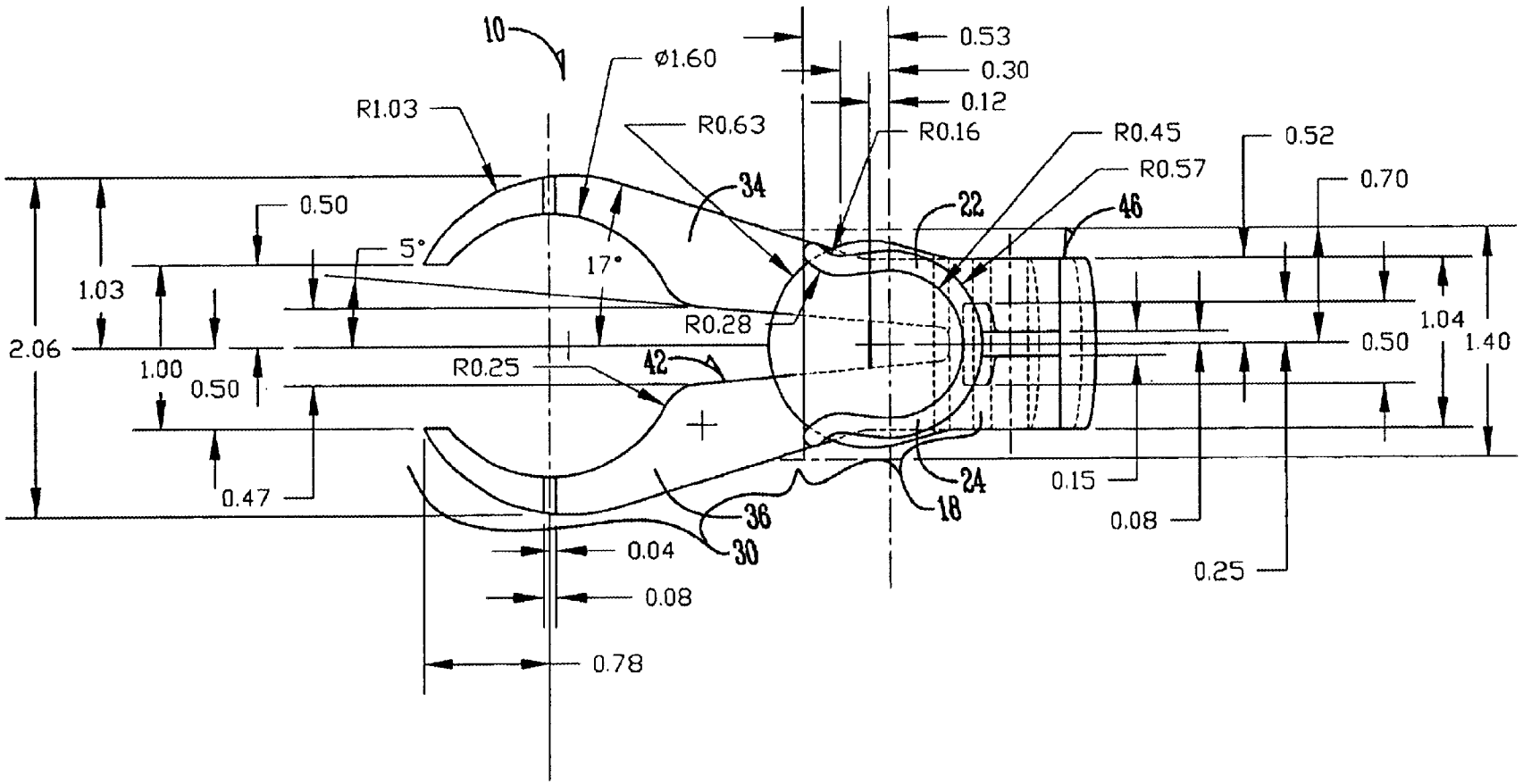
FIG. 2 is a top plan view of the tool of FIG. 1, including dimensions of an exemplary embodiment.
Figures 3A, 3B:
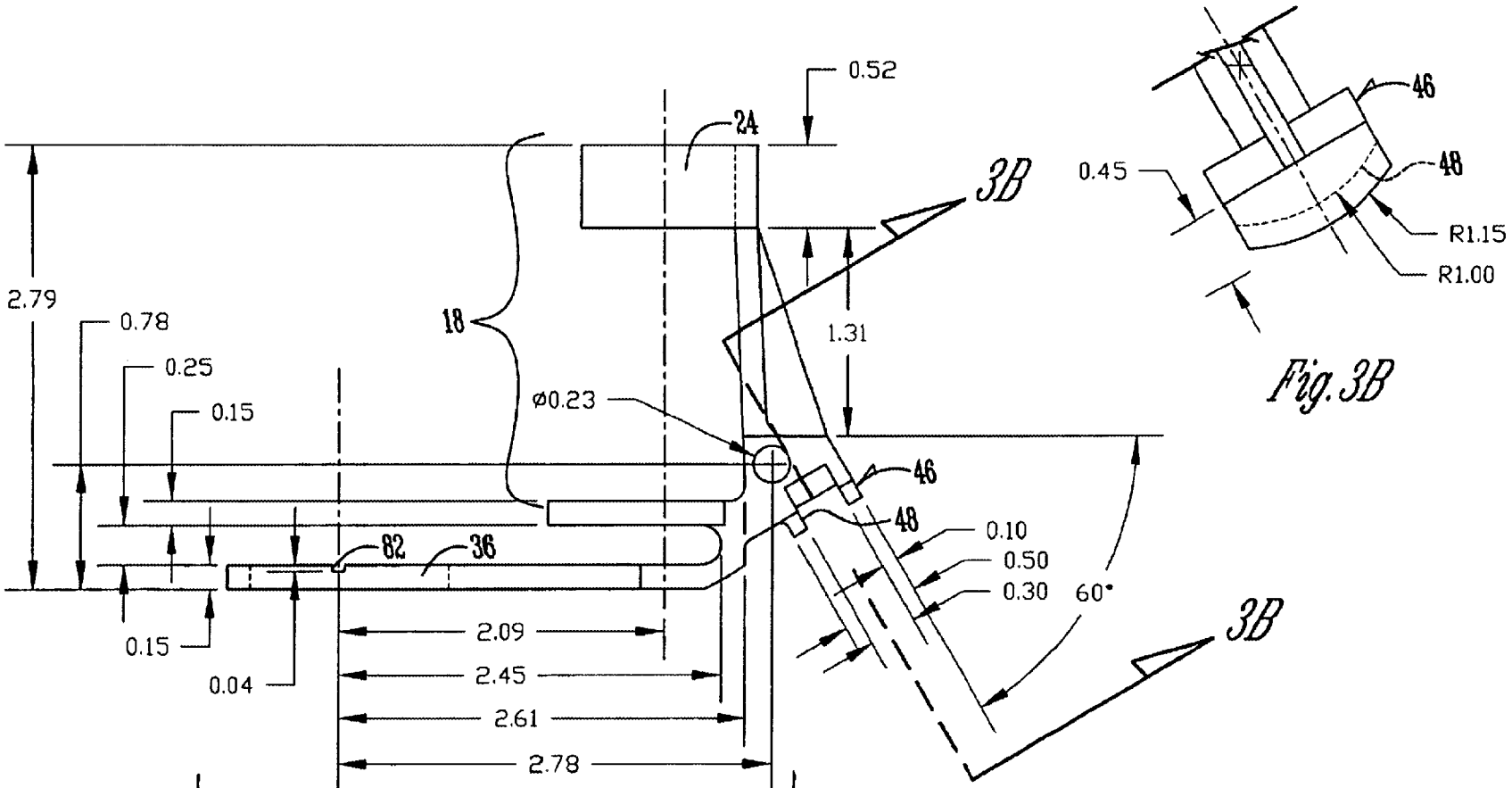
FIG. 3A is a side elevational view of the tool of FIG. 2, also with dimensions.
FIG. 3B is an isolated elevation view taken along line 3*b*—3*b* of FIG. 3A.

In order to obtain a better understanding of the invention, one example of how the invention can be manufactured and utilized will now be described in detail. Frequent reference will be taken to the above-identified figures. Reference numerals will be used to indicate certain parts and locations in the figures. The same reference numerals will be used to indicate the same parts and locations throughout the Figures unless otherwise indicated.

It is to be understood that this exemplary embodiment is but one way the invention can be made and used. This one example is illustrative only and not by way of limitation.

B. Structure

FIGS. 1, 2, 3A and 3B illustrate the basic structure of the exemplary embodiment, which will be referred to generally as tool 10. Tool 10 includes three major functioning sections. First, a golf club handle clamp (indicated generally at reference numeral 12) functions to snap on releasably or reversibly to the distal end of conventional golf clubs (see FIGS. 5–6 and 8–10). Secondly, what will be called a scissors scoop (indicated generally at reference numeral 30), functions to pick up (or "pop up") and cradle or grip a golf ball. Third, a tee slot (indicated generally at reference number 42) functions to hold a tee in position to allow it to be forced into the ground and then released in place in the ground.

Each of these three sections cooperate to allow a golfer to install tool 10 on the grip end of a golf club and then grab the shaft or the head end of the golf club to (a) insert a tee in the ground at the appropriate position and height for the golfer to tee up a golf ball, (b) place a ball in the scissors scoop (or pick up a ball that is on the ground) and move the ball to the tee, place the ball on the tee and remove the tool, all without any substantial bending or stooping.

A fourth optional portion of tool 10 is called a tee pick (indicated generally at reference numeral 46) adapted to allow the golfer to pick up a tee laying on the ground without bending or stooping.

Additionally, the scissors scoop can be used to pick up or move a golf ball from the ground, e.g., if out of bounds, under a tree or bush, or simply pick it up to clean it or remove it from the green. Still further, the scissors scoop can be used to pull the ball out of the golf cup.

Tool 10 is one piece. It is made out of plastic material and could be molded for efficiency and economy. In one embodiment, tool 10 is made out of a polycarbonate or glass-filled nylon (e.g. 13% glass filled). It could be made out of recycled plastic for further economy and reuse of resources. Of course, however, tool 10 does not need to be one piece or be made of any of those materials. One example of a material for tool 10 is 66 Nylon.

As can be appreciated, the dimensions of tool 10 can be developed according to desire and need. One example of such dimensions is specifically illustrated in FIGS. 2 and 3A and B because, for optional functioning, some of the dimensions are critical relative to such things as diameter of conventional golf balls, diameter of most types of shafts of tees, and diameter of conventional golf club shafts or grips. As will be further appreciated, for the specific tool 10 now being described, the material, at least for the scissors scoop, must have the ability to have some flexure, and preferably resilient flexure as will be further explained.

C. Structural Relationship To Golf Balls and Tees

Figure 4:
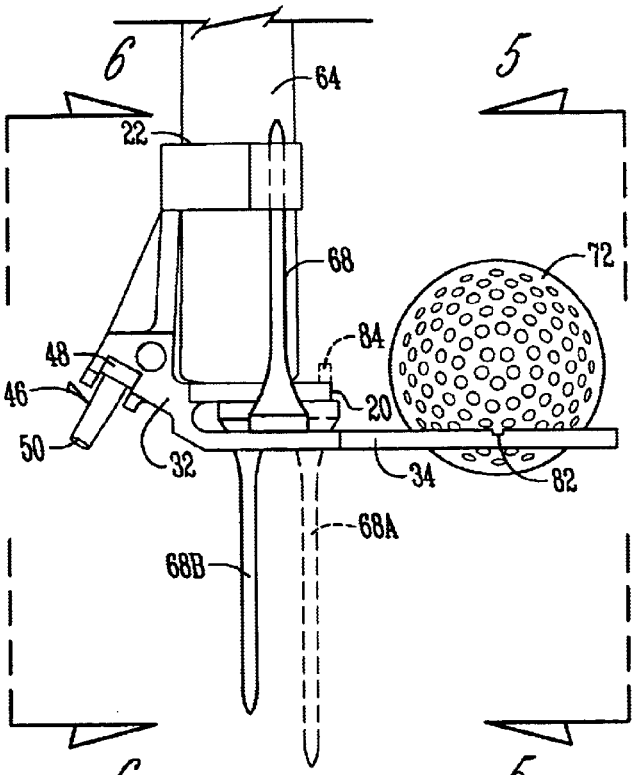
FIG. 4 is a reverse side elevation view of the tool of FIG. 3 but showing installation of a golf club to the tool, two different sized tees prepared for insertion in the ground, the supporting or cradling of a golf ball, and the storage of an extra tee or tees.

FIGS. 4–7 illustrate a tool substantially similar to tool 10 of FIGS. 1–3A/B, and further illustrate the relationship and functional cooperation with a golf club, a golf ball and golf tees. As can be seen in FIG. 4, and with further reference to FIGS. 1 and 3, scissors scoop 30 includes opposite jaws 34 and 36, here generally mirror images of one another. Jaws 34 and 36 extend from base 32. Their junction with base 32 comprises a narrowed portion for each jaw. This narrow portion is configured to act essentially as a living hinge such that when outward force in the plane of jaws 34 and 36 is experienced by either jaw 34 or 36, it/they would spread. The inherent property of the material of tool 10, however, would cause the jaws 34 and 36 to consistently return to the normal position shown in FIG. 1 after such force(s) is/are released.

Figure 7:
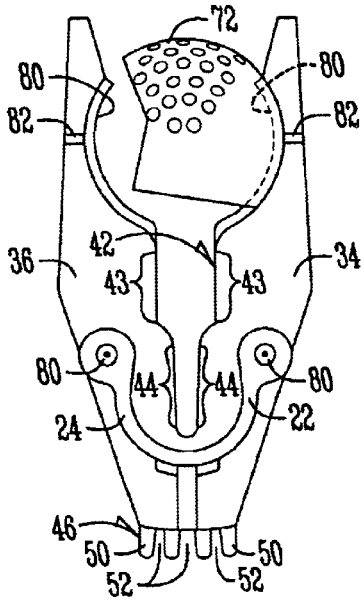
FIG. 7 is a top plan view of FIG. 4 with a portion of the ball and seat 20 removed.

The facing inner edges of jaws 34 and 36 define an opening 40. As illustrated in FIGS. 1 and 7, opening 40 is generally circular in nature and is defined by a diameter, which is less than the greatest outside diameter of a conventional golf ball. This allows a golf ball to be seated or cradled in opening 40 such that tool 10, when installed on the end of golf club 60, can be used to push jaws 34 and 36 straight down on and past golf ball 72, to then cradle golf ball 72, and allow golf ball 72 to be moved to a desired position as long as the plane of jaws 34 and 36 is kept substantially horizontal. Alternatively, jaws 34/36 could be scooped under ball 72 to cradle ball 72.

The opening 40 is not completely bordered by jaws 34 and 36, having an entrance gap 38 at the distal end of jaws 34 and 36, and a gap 41 at the entrance to tee-slot 42, at the distal end tee-slot 42.

The configuration and dimensions of tee-slot 42 are selected such that, as shown in FIGS. 2, 4, 5, and 7, the shaft of a tee near its head could be moved into the distal portion of tee-slot 42 (what will be called the converging entrance or section 43 of tee-slot 42) and then channeled back into a rear converging holding area 44 of tee-slot 42. The diameter of the shaft The configuration and dimensions of tee-slot 42 are selected such that, as shown in FIGS. 2, 4, 5, and 7, the shaft of a tee near its head could be moved into the distal portion of tee-slot 42 (what will be called the converging entrance or section 43 of tee-slot 42) and then channeled back into a rear converging holding area 44 of tee-slot 42. The diameter of the shaft of the tee will determine how far back in holding area 44 the tee will be allowed to travel. For example, FIG. 4 illustrates how two different sized tees 68A and 68B could be held in tee slot 42. A conventional 2 ⅛ inch long tee 68B usually has a slightly smaller shaft diameter than a conventional 2 ¾ inch long tee 68A. The slight converging taper of section 44 of tee slot 42 is configured to grip the shaft of either tee 68A or B. Tee 68B has to be moved back or proximally in slot 42 more than tee 68A to be gripped.

Note further that the space between the bottom of end stop/seat 20 of handle clamp 12 and the top surfaces of jaws 34 and 36 approximates the height of the head of most conventional tees. Opposite facing edges of the converging holding area 44 could include a bevel or edge 45 that can serve to help grip the shaft of the tee once inserted. Holding area 44 converges such that the lateral distance between edges of holding area 44 is slightly less than the diameter of most tees shafts. The resiliency of the material of tool 10 and/or of jaws 34 and 36 allow the tee to be interference-fit into or resiliently gripped in slot 42, and held in place.

As indicated in FIGS. 4–7, extra tees 68 could be inserted in holes 80 of handle claim 12 as a storage function.

Figure 5:
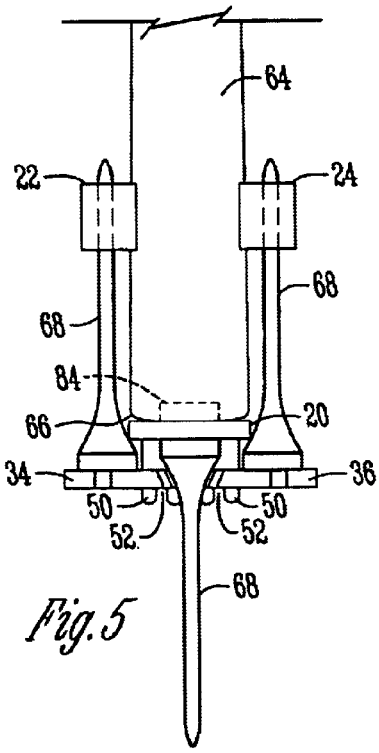
FIG. 5 is an end elevation view along line 5—5 of FIG. 4 without the golf ball.
Figure 6:
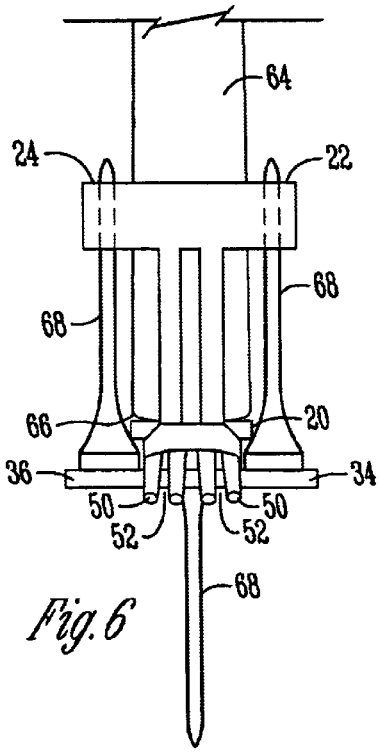
FIG. 6 is a reverse end elevation view of the tool of FIG. 4, taken along line 6—6 of FIG. 4, without the golf ball in place.

FIGS. 4–6 also illustrate how handle clamp 12 functions. A clip-on collar 18 includes mirror-image arms 22 and 24 extending from spine 16, which is connected to heel 14 of tool 10. Arms 22 and 24 define an opening 28 which has a diameter similar to, or slightly less than, the diameter of most golf club handle grips near their distal end. A gap 26 between the distal ends of arms 22 and 24 allows lateral entry of golf club grip 64 sufficient to spread arms 22 and 24 and then snap-fit golf club grip 64. When tool 10 is installed, the very distal end of golf club grip 66 should abut the top surface of end stop/seat 20 extending from heel 14 of tool 10 (see FIGS. 4–6). Optionally, a raised curved grip stabilizer 84 could be placed along a FIGS. 4–7 illustrate tee pick 46. Tee pick 46 could be made out of a separate material, such as synthetic rubber, such that it has a little more flexibility and higher coefficient of friction then the remainder of tool 10. It could be interference-fit into a slot, receiver(s), and/or base 48 in the heel 14 of tool 10, or glued or otherwise attached. Its fingers 50 define tapered gaps 52 between adjacent fingers which are sized such that the diameter of a shaft of a normal tee could pass through the entrance to the slots or gaps 52, but then the convergence of the width of gaps 52 is such that the tee's shaft would frictionally engage adjacent fingers, allowing the tee to be picked off the ground or some other surface.

D. Operation

Figure 8:
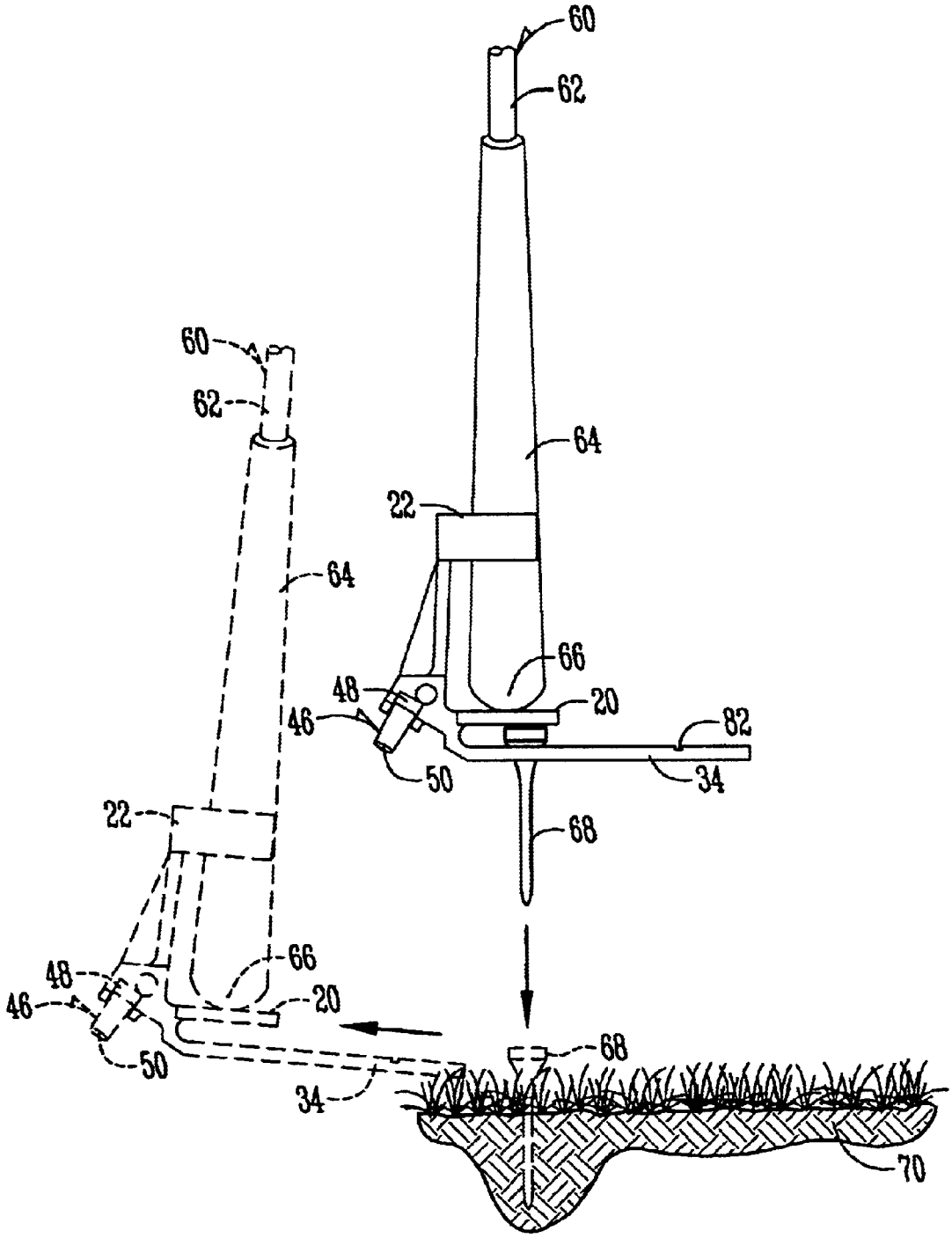
FIG. 8 is a diagrammatic illustration of utilization of the tool of FIGS. 1–7, installed on a golf club, to insert a tee into ground in preparation for teeing off.

With reference to FIGS. 1–7, and further reference to FIGS. 10–13, use of tool 10, installed on golf club 60, will be further described. FIG. 8 illustrates in solid lines a tee 68 slid into tee slot 42 sufficiently such that holding area 44 grips it shaft. End stop/seat 20 prevents tee 68 from moving towards golf club handle 64 (in an upward direction in FIGS. 4, 5, 6, and 8). Tee slot 42 prevents tee 68 from moving longitudinally away from handle 64 (in a downward direction in FIGS. 4, 5, 6, and 8). The beveled adjacent edges of holding area 44 hold tee 68 in the position shown in FIG. 8. The user, grasping a portion of golf club 60 away from grip 64, without substantial stooping or bending, can hold golf shaft 62 generally upside down and vertically and force tee 68 into the ground a desired depth by pushing down on club shaft 62. Force essentially goes from the user's hand(s) through the rigid shaft 62, through end stop/seat 20, to the head of tee 68, forcing the tee into the ground, even if the ground is substantially hard, because essentially the rigidity and strength of the golf club shaft, and the rigidity and strength of the end stop/seat 20, are aligned with and in abutment with the head of the tee.

It is to be understood that once tee 68 is in the ground (see dashed line version of tee 68 in FIG. 8), the golfer moves golf club shaft 62 laterally along ground 70 to remove tool 10 from tee 68 (i.e. tee would move through holding area 44, and converging area 43 of tee slot 42, and then through gap 40, through opening 40, and out gap 38 of tool 10, and thus easily released in place in the ground). It is to be further understood, by reversing that process, without stooping or bending, the golfer could adjust tee 68 relative its height in the ground by moving tool 10 from the position in broken lines in FIG. 8 to the position in solid lines, to reinsert tee 68 in tee slot 42 and then either push the tee in further or raise it a bit if needed or desired, and then remove tool 10 as previously discussed. A golfer could also reinsert tee 68 in tee slot 42, pull it from the ground, and pierce it into the ground at another location.

Figure 9:
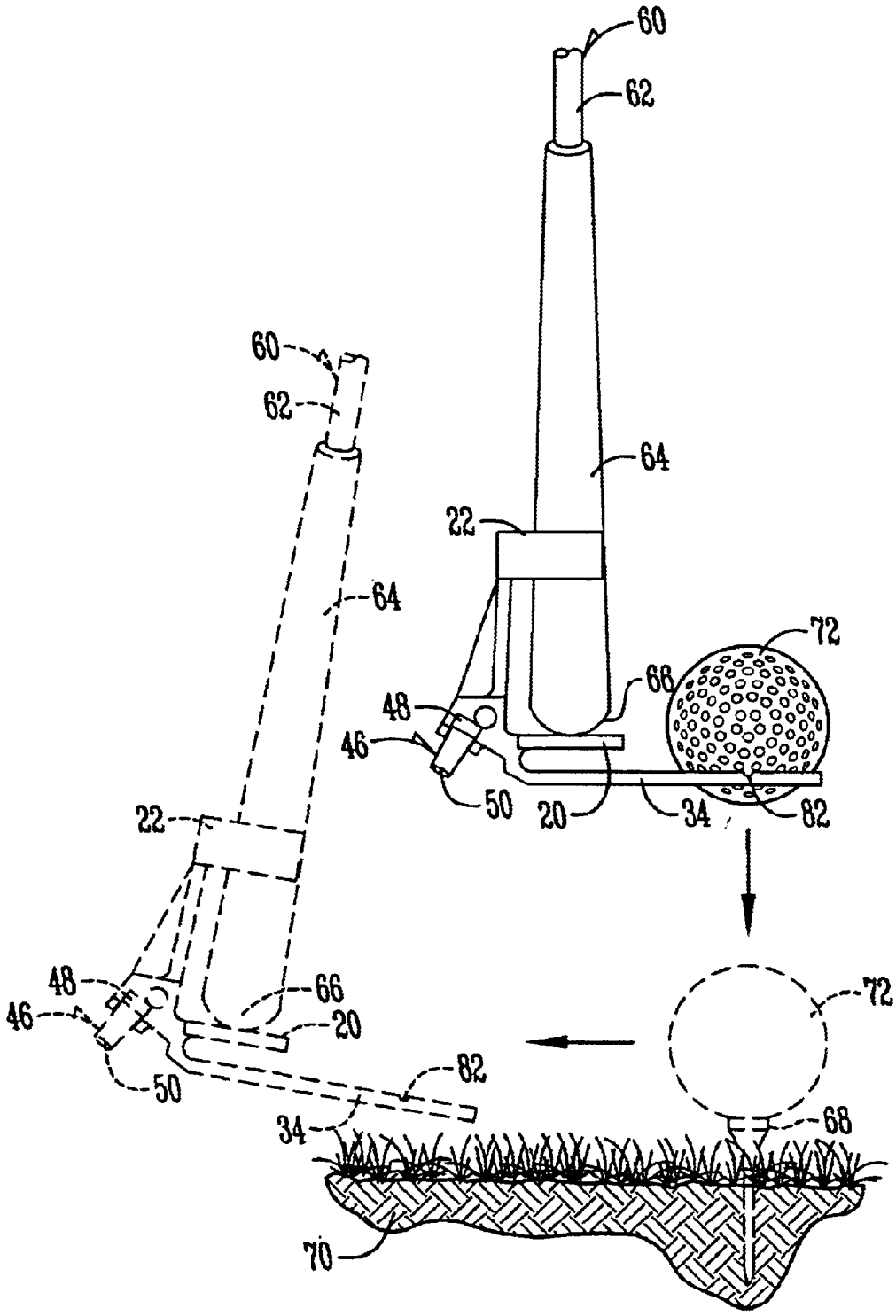
FIG. 9 is a diagrammatic illustration of use of the tool of FIGS. 1–7 to place a golf ball on a tee inserted in the ground.

FIG. 9 illustrates another functional step that can be utilized with tool 10. Once tool 10 is installed on golf club 60, the golfer can manipulate golf club 60 with tool 10 in the position shown in FIG. 9 and place a ball 72 into opening 40 of scissors scope 30 such that it is basically just cradled in opening 40. The golfer then simply moves club 60 (with ball in place) over tee 68 and lowers tool 10 by lowering golf club 60 while aligning the bottom of golf ball 72 with the top of tee 68 in the ground. To assist alignment of ball 72 with the tee head, as indicated at FIGS. 1, 4 and 7, indicia such as grooves 82 (or raised portions, markings or colorings or other perceivable indicia to bisect opening 40) can be placed on top of jaws 34 and 36 to indicate the center diameter of opening 42 so that the golfer can be assisted to know better where the ball should be lowered for set-up on tee 68.

As illustrated in dashed lines in FIG. 9, and as can be appreciated with reference to other drawings, the golfer can test the ball to see if it is accurately positioned on tee 68 by further lowering tool 10. If the ball independently stays in the concave of the head of tee 68, the golfer simply continues to lower tool 10 a little bit more and then removes tool 10 by moving it laterally (see broken lines of FIG. 9) such that the tee moves out of opening 40 through gap 38 to easily and quickly remove tool 10, with tee 68 still in place in the ground and ball 72 now in place, teed up, on the top of tee 68. Like previously described, reversing that procedure, bringing tool 10 underneath ball 72 and then lifting up tool 10 vertically would allow golfer to remove the ball if desired. The tee and/or ball could be adjusted or repositioned.

Figure 10:
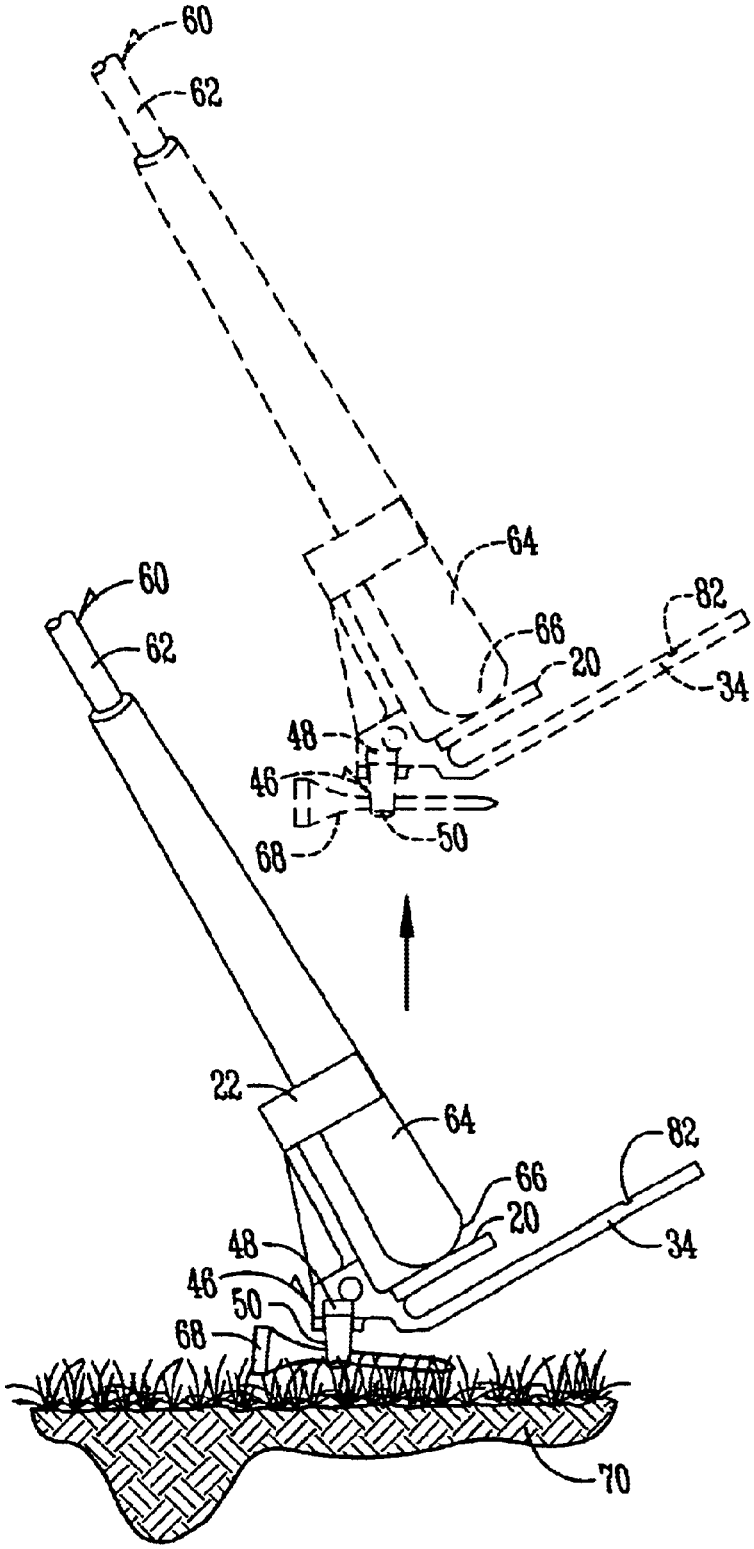
FIG. 10 is diagrammatic illustration of use of the tool of FIGS. 1–7 to pick up a tee laying the ground.

FIG. 10 illustrates operation of tee pick 46. In solid lines, the tool 10, installed on golf club 60, can be manipulated by the golfer such that two fingers 50 surround the shaft of tee 68 and frictionally grip it. As shown in dashed lines, the user simply lifts tool 10 (with tee 68 in tee pick 46) by manipulating golf club 60, and can then move the tee up to position where the user can, with his or her hand, remove the tee from tee pick 46 without substantial stooping or bending.

Figure 11A:
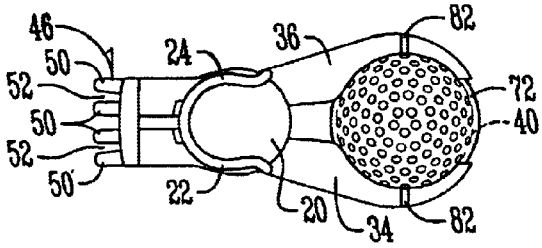
FIGS. 11A and B, 12A and B, and 13A and B, are top plan views and side elevational views, respectively, illustrating various states of address, and utilization of, part of the tool relative to a golf ball.
Figure 11B:
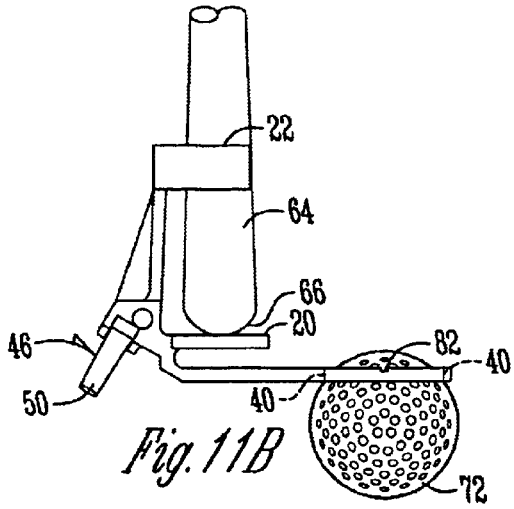
Figure 12A:
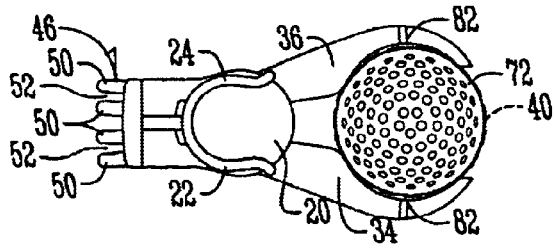
Figure 12B:
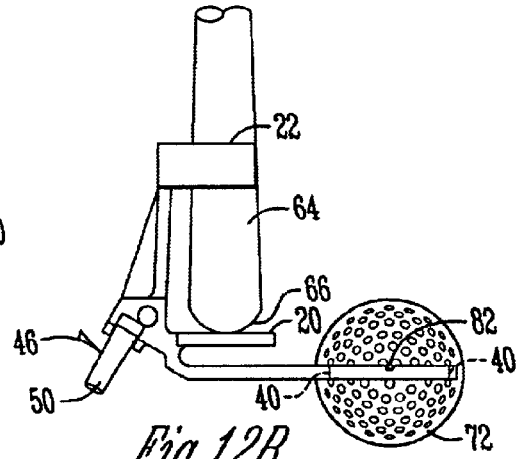

It is to be understood that scissors scoop 30 can function in several ways to assist the golfer. Scooping underneath a ball or cradling the ball in opening 40 has been discussed. However, FIGS. 11–13 illustrate that tool 10, by utilizing the resiliency of the connection of jaws 34 and 36 to base 32 of tool 10, can also pick up a ball in the following way. As shown in FIGS. 11A and B, tool 10 can be manipulated such that opening 40 is aligned over the top of golf ball 72. In normal position of jaws 34 and 36, opening 40 has a diameter less than the greatest outside diameter of ball 72. By exerting downward pressure through golf shaft 62, as shown in FIGS. 12A and B, jaws 34 and 36 would deflect laterally slightly and slide out frictionally to the widest diameter of golf ball 72. Opening 40 would also expand to approximately the greatest outside diameter of ball 72 and surround the largest diameter of ball 72. If further downward motion is stopped, when the jaws are around essentially the widest diameter (or equator) of the golf ball, the resiliency of the connection of jaws 34 and 36 to tool 10 is made sufficient that jaws 34 and 36 would grip, as opposed to simply cradle, ball 72. This would allow plane of jaws 34/36 of the tool 10 to be turned or otherwise reoriented substantially away from horizontal without having ball 72 move out of scissors scoop 30. Ball 72 is essentially pinched by jaws 34 and 36. Without such inward resiliency of jaws 34/36, ball 72, ball 72 could not be lifted and moved by tool 10 unless cradled, as previously described (see, e.g. FIGS. 4 and 9). Also, if merely cradled by tool 10 (as opposed to pinched), ball 72 would roll out of the cradle of opening 40, or not hold ball 72, if the plane of jaws 34 and 36 is not substantially horizontal.

Figure 13A:
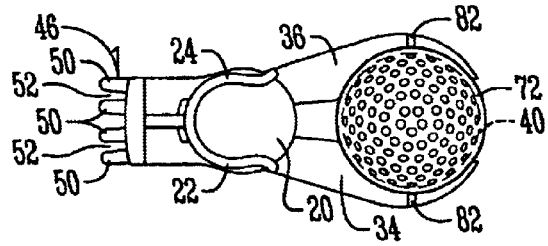
Figure 13B:
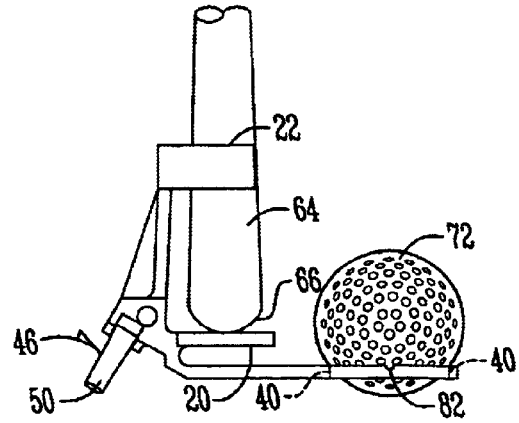
Figure 14A:
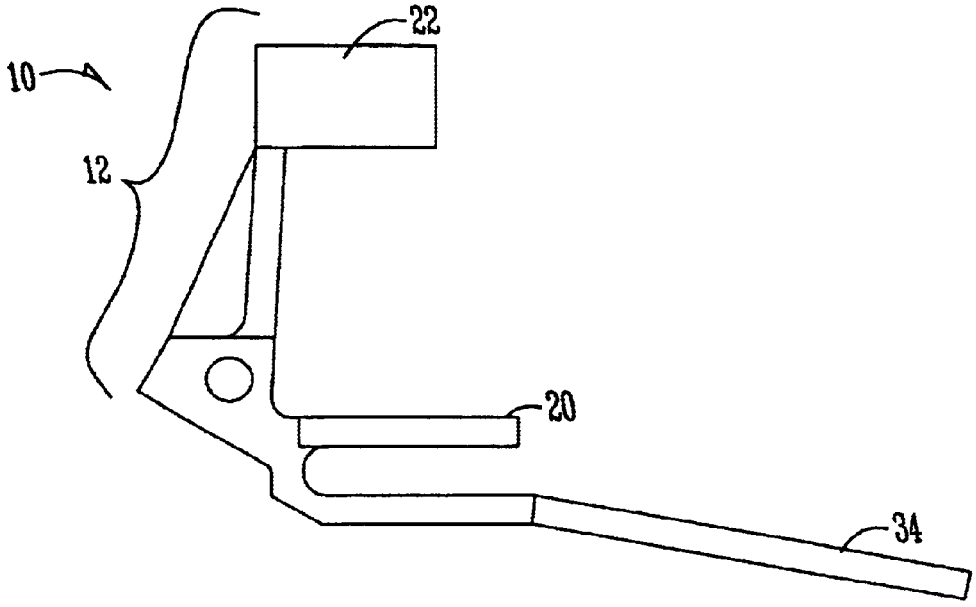
FIGS. 14A and B are side elevational views of alternative embodiments according to the present invention.
Figure 14B:
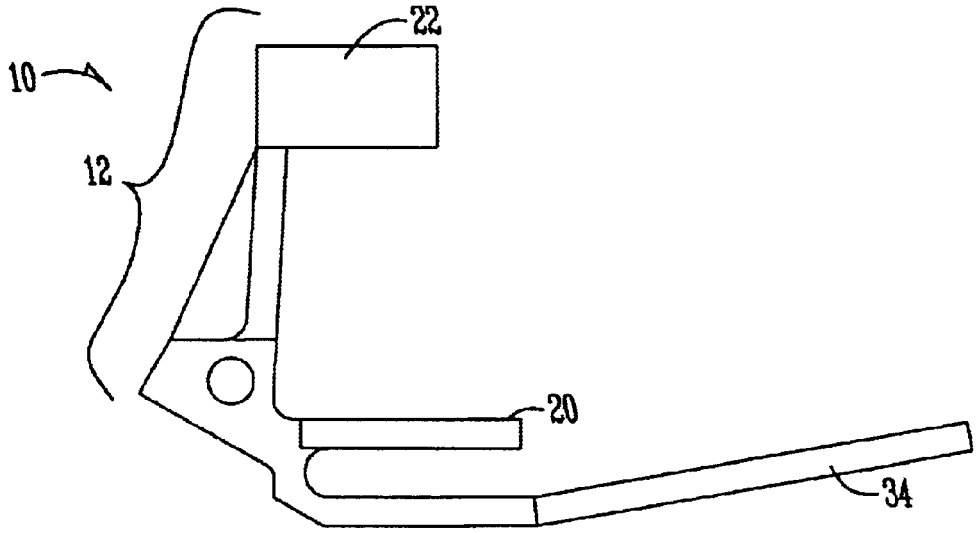

But further, as indicated by FIGS. 13A and B, if ball 72 is on the ground or on a tee and further downward vertical force is made through golf club 60 to tool 10, jaws 34 and 36 would slide below the equator of ball 72. The resiliency would cause them to converge to normal position and they could then cradle ball 72. As previously described, if tool 10 is maintained substantially in the position such that jaws 34 and 36 are generally horizontal, ball 72 can then be moved around while it is cradled by jaws 34 and 36. This function of FIGS. 11–13 allows a ball to be picked up without scooping underneath the ball by rather gently punching directly down on the ball (causing ball 72 to pop up through jaws 34/36). It also allows the ball to be left on the tee by first gripping, as opposed to cradling the ball, and once on the tee, moving the tool further downward. It also allows the golfer to pick a ball up off the ground by this popping up through jaws 34/36, as opposed to trying to scoop under the ball.

E. Options and Alternatives

As previously stated, the exemplary embodiment is shown for purposes of example and illustration only and not by way of limitation. The invention can take many forms and embodiments. The scope of the invention is defined solely by the claims and not by the exemplary embodiment. Variations obvious to those skilled in the art will be included within the scope of the invention.

For example, not all of the functional features of tool 10 are required. The scissors scoop alone could be implemented in the tool, without the tee slot or tee pick. Or the tee slot alone could be implemented without the scoop or tee pick. Other combinations could be implemented.

Furthermore, as discussed, materials and dimensions can vary according to need and desire. Tool 10 is approximately 4 inches long, 2½ inches wide (across jaws 34/36), and 2 inches tall.

Additionally, the connection and cooperation of the different functional features can vary. For example, the handle clamp can be aligned with the longitudinal axis of the scissors scoop 30 or they could be oblique to one another instead of orthogonal. Likewise, tee pick 46 could be at an oblique angle to both handle clamp 12 and scissors scoop 30.

Furthermore, it is to be understood that tool 10 can easily be carried in the golfer's pocket. The gap between end stop/seat 20 and top of scissors scoop 30, around converging holding area 44 to tee slot 42, could act as sort of a clip for the user to place jaws 34 and 36 in his or her pocket such that distal ends of jaws 34 and 36 extend into the pocket and the end stop/seat 20 is outside the pocket. It could also be clipped or carried similarly on other structure, e.g., on a golf bag or strap of a golf bag.

Furthermore, as discussed, scissors scoop 30 of tool 10 are configured so they can be inserted into a golf cup such that the distal ends of jaws 34/36 move past and towards the bottom of ball 72 when in the cup. By upward movement of tool 10, ball 72 can be lifted out of the cup because jaws 34 and 36 would be sufficiently underneath ball 72 to move ball 72 up and out of the cup by raising golf club 60. Again, this can be done without substantial bending or stooping. Alternatively, jaws 34 and 36 could be operated to the gripping mode to grip to then pull the ball out of the without substantial bending or stooping.

As can be seen in comparing FIGS. 1–3 and 4–13, minor differences between tool 10 are shown, but the functions are the same.

What is claimed is:

1. A golf tool comprising:

(a) a body;

(b) a receiver connected to the body, the receiver having an open area adapted to removably receive a golf club handle;

(c) a ball holder connected to the body adapted to releasably receive and support a golf ball;

(d) a plurality of fingers extending from the body, at least one finger being resilient and defining a gap with another finger, so that the fingers are adapted to slightly deflect and return to frictionally engage the shaft of a golf tee, wherein the plurality of fingers extend obliquely to a golf club handle once installed in the tool.

2. The tool of claim 1 wherein the body comprises a unitary piece of material.

3. The tool of claim 2 wherein the unitary piece of material is plastic.

4. The tool of claim 3 wherein the plastic is moldable.

5. The tool of claim 1 wherein the receiver comprises at least one resilient clamping member defining a gap through which a golf club handle snap-fits, and is retained against lateral movement.

6. The tool of claim 5 wherein the receiver further comprises an end stop member limiting axial movement of the golf club handle when installed.

7. The tool of claim 5 wherein the clamping member further comprises at least one arm having a proximal end connected to the body and a distal end which is resiliency deflectable.

8. The tool of claim 7 further comprising a second arm having a proximal end connected to the body and a distal end which is resiliently deflectable, the distal ends in the first and second arms defining the gap of the clamping member.

9. The tool of claim 7 wherein the end stop member comprises an extension from the body.

10. The tool of claim 1 wherein the golf ball holder comprises an extension with an opening for supporting a golf ball.

11. The tool of claim 10 wherein the extension comprises an arm extending along the opening.

12. The tool of claim 11 wherein the arm is resiliently deflectable.

13. The tool of claim 12 further comprising a second arm opposite the first arm, the second arm being deflectably resilient, to allow positioning of the arms relative to a golf ball and, with sufficient force pushing down on the ball resiliently deflecting the arms around the ball.

14. The tool of claim 13 further comprising release of downward pressure on the arms causing the arms to resiliently grasp the ball around its equator.

15. The tool of claim 14 wherein when the arms are returned to normal position, the ball is cradled and supported by the arms.

16. The tool of claim 10 wherein the extension extends obliquely to the handle of a golf club once installed in the tool.

17. The tool of claim 10 wherein the extension extends generally perpendicular to the handle of a golf club once installed in the tool.

18. The golf tool of claim 1 wherein the fingers are tapered from thicker at the body to thinner at distal ends.

19. The golf tool of claim 18 wherein the distance between fingers at their distal ends is approximately the diameter of shafts of conventional golf tees or larger and reduces to a distance less than the diameter of shafts of conventional golf tees.

20. The golf tool of claim 1 wherein the fingers are made of material having a high coefficient of friction.

21. The golf tool of claim 20 wherein the material is rubber.

22. The golf tool of claim 1 wherein the fingers are aligned generally in the same plane.

23. The golf tool of claim 22 wherein the body comprises an outwardly curved surface, the fingers extend from the outwardly curved surface such that distal ends of the fingers spread from one another.

24. The golf tool of claim 1 wherein the body comprises an outwardly curved surface, the fingers extend from the outwardly curved surface, and distal ends of the fingers spread from one another.

25. The golf tool of claim 1 wherein the fingers are made of a material different from the body.

26. A golf accessory for handling golf balls and tees without substantial bending or stooping comprising:

(a) a first member adapted to releasably snap-fit to the grip end of a golf club to hold the accessory against movement relative to the golf club;

(b) a second member connected to the first member and having an extension adapted to cradle a golf ball, so that when a golf club is installed in the first member a user can move the ball to the desired position, including on a tee, and remove the accessory from the ball without bending or stooping, wherein the second member comprises an opening with a diameter less than the greatest outside diameter of a conventional golf ball and the extension comprises a jaw which is resiliently deflectable.

27. The accessory of claim 26 wherein the first member comprises a clamp member having an opening through which a golf club grip end laterally snap-fits.

28. The accessory of claim 27 wherein the opening of the first member has a smaller width than the outside diameter of golf club grip end.

29. The accessory of claim 27 wherein the first member comprises a stop member cooperating with the clamping member to create a longitudinal stop relative to the distal end of the golf club grip end to prevent longitudinal movement of the club once installed in the accessory.

30. The accessory of claim 26 further comprising a second jaw on an opposite side of the opening, the second jaw being resiliently deflectable.

31. The accessory of claim 26 wherein the opening of the second member is general circular and less than the outside diameter of the equator of a golf ball and further comprising an entry opening.

32. The accessory of claim 26 further comprising a slot defined by opposite walls of the body of the accessory, the slot having an entrance opening wider than the diameter of the shafts of a conventional golf tees and converging to a distance less than the diameter of conventional golf tees.

* * * * *